United States Patent [19]

Janke

[11] 3,964,376

[45] June 22, 1976

[54] TAMPER-PROOF WEATHER COVER DEVICE FOR EXHAUST PIPES

[76] Inventor: William R. Janke, Rte. No. 3, Northfield, Minn. 55057

[22] Filed: Dec. 11, 1974

[21] Appl. No.: 531,758

[52] U.S. Cl. ..... 98/59

[51] Int. Cl.[2] ..... F23L 17/02

[58] Field of Search ..... 98/59, 122; 137/499, 137/467; 220/214; 292/231

[56] References Cited

UNITED STATES PATENTS

| | | | |
|---|---|---|---|
| 641,028 | 1/1900 | Meehan | 98/122 |
| 3,274,917 | 9/1966 | Tolbery, Sr. | 98/59 |
| 3,407,720 | 10/1968 | Westerman | 98/59 |
| 3,667,260 | 6/1972 | Foote | 98/59 X |

FOREIGN PATENTS OR APPLICATIONS

| | | | |
|---|---|---|---|
| 648,119 | 12/1950 | United Kingdom | 98/59 |
| 26,601 | 6/1911 | United Kingdom | 98/59 |

*Primary Examiner*—William F. O'Dea
*Assistant Examiner*—Harold Joyce
*Attorney, Agent, or Firm*—Stuart R. Peterson

[57] ABSTRACT

A hinged lid closes the upper end of the vertical exhaust pipe of an internal combustion engine to keep rain and snow from entering the engine when it is shut down. A latch prevents vandals from manually opening the lid, but the latch is automatically released by the force of the exhaust gases striking a pivotal vane carried on the underside of the lid when the engine is started. The escaping exhaust gases also act against the lid to open it, and the lid remains open as long as the engine continues to operate. However, each time the engine is shut down the lid is again automatically latched closed and cannot be manually opened. This prevents the pouring of water, sand or other debris into the exhaust pipe by vandals, and has the added advantage of keeping the lid from being blown open by the wind. Provision is made for utilizing a conventional padlock so as to externally lock the lid closed or, if desired, to lock the lid open.

25 Claims, 9 Drawing Figures

TAMPER-PROOF WEATHER COVER DEVICE FOR EXHAUST PIPES

BACKGROUND OF THE INVENTION

1. Field of the Invention

This invention relates generally to devices for covering the upper end of a vertical exhaust pipe to prevent the entrance of rain and snow, and pertains more particularly to such a device having a lid which is automatically latched closed when the internal combustion engine is shut down and automatically released when the engine is running.

2. Description of the Prior Art

Pivotal lids have been used for many years to cover the upper ends of vertical exhaust pipes, thereby preventing rain and snow from entering the exhaust pipe and falling down into the internal combustion engine where damage can occur from the resulting rusting or corrosion. For the most part, these covering devices have worked satisfactorily, although difficulties have been encountered as far as opening by wind action. Even more importantly, problems have arisen in the past from vandalism where the vandals open the covering device for the purpose of mischievously introducing foreign matter into the exhaust pipe which substances can seriously damage the internal combustion engine.

One attempt to minimize the likelihood of the exhaust cover inadvertently opening due to wind action is described in U.S. Pat. No. 3,407,720 for EXHAUST COVER, granted Oct. 29, 1968, to Albert M. Westerman. While the disc-like cover or lid illustrated in said patent is free to open when exhaust gases are flowing, if the wind action is sufficiently severe when the engine is shut down, an increase in frictional binding occurs so that there is greater resistance to the external wind forces and the lid, under these conditions, remains closed. Provision is made for the manual opening of the cover from outside should circumstances so warrant.

Another device that has been contrived to obviate the opening from wind action is the device disclosed in U.S. Pat. No. 3,334,932, issued on Aug. 8, 1967, to Henry V. Buresh for TRANSPORT-STORAGE LATCH. In this instance a manual latching operation is required, a hook arrangement being contemplated. The lid or cap remains locked until manually unlatched.

As might be expected, efforts have been made to lock weather covers in a closed position in order to discourage vandalism. An example of such an effort is the padlock arrangement depicted in U.S. Pat. No. 3,667,260, granted to Daniel J. Foote on June 6, 1972, for EXHAUST PIPE PROTECTOR LOCK. It is necessary to manually lock and unlock the cover, a special padlock being contemplated.

SUMMARY OF THE INVENTION

A general object of the invention is to provide a self-locking cover device for the upper end of a vertical exhaust pipe which will automatically open when the internal combustion engine is started. In this way, the device, when locked, precludes tampering by vandals for the purpose of introducing foreign substances into the engine via the exhaust pipe. Still further, the locking action derived from my cover device prevents inadvertent opening from wind forces. More specifically, an aim of my invention is to provide a cover device which will be opened only from the pressural action derived from the exhaust gases themselves and not from any external forces.

Another object of the invention is to provide means for positively locking the cover device in either an open position or closed position, a conventional padlock being contemplated. In this way, the lid of my cover device can be maintained open so that a visual inspection or possible cleaning of the exhaust pipe can be consummated. On the other hand, when the equipment having my cover device installed thereon is being transported in a non-operating condition, the lid can be locked closed so as to prevent the entrance of branches and the like should my device ever become damaged so as to render it ineffectual. It will be appreciated that the use of a padlock is in addition to the automatic locking and unlocking feature embodied in my invention.

Briefly, my invention contemplates a counter weighted hinged lid and a pivotal vane carried therebeneath which by gravity action causes a latch to become effective, thereby preventing the lid from opening, or being opened, unless there is a sufficient flow of exhaust gases. Whenever the internal combustion engine is shut down, the counter weighted lid automatically closes and the locking or latching thereof simultaneously takes place. When the engine is started up, there is an impingement of exhaust gases initially against the vane so as to unlatch the lid. The exhaust gases also act against the lid itself to maintain it open. Should circumstances require that the lid be held closed (or open), provision is made for accomplishing this with a conventional padlock.

Two embodiments are planned. In one there is a sleeve-like member that is initially slipped over the upper end of the vertical exhaust pipe. Appropriate rivets are employed which prevent the removal of the sleeve. A strap clamp can be utilized in addition to the rivets to further discourage any removal of the device once it has been installed. In the second embodiment, a resilient strap is employed which makes use of a bolt and nut combination that cannot be easily removed, thereby providing reasonable assurance that the strap will remain in place. The lid is hinged in this instance to the strap, whereas in the first embodiment it is hinged to the sleeve member.

DESCRIPTION OF THE PREFERRED EMBODIMENT

Various types of self-propelled equipment make use of vertical exhaust pipes. An example of such equipment is the tractor depicted in U.S. Pat. No. 2,983,216. Other illustrations would be various types of trucks, road graders, mechanical shovels, such as back hoes, and the like. Still further, in order to make use of my invention, the equipment need not be mobile, for it can equally well be stationary, such an internal combustion engine for operating a compressor, or hoist on a construction project. My invention will be of benefit wherever an internal combustion engine having a vertical exhaust pipe is left unattended.

Figure 1:
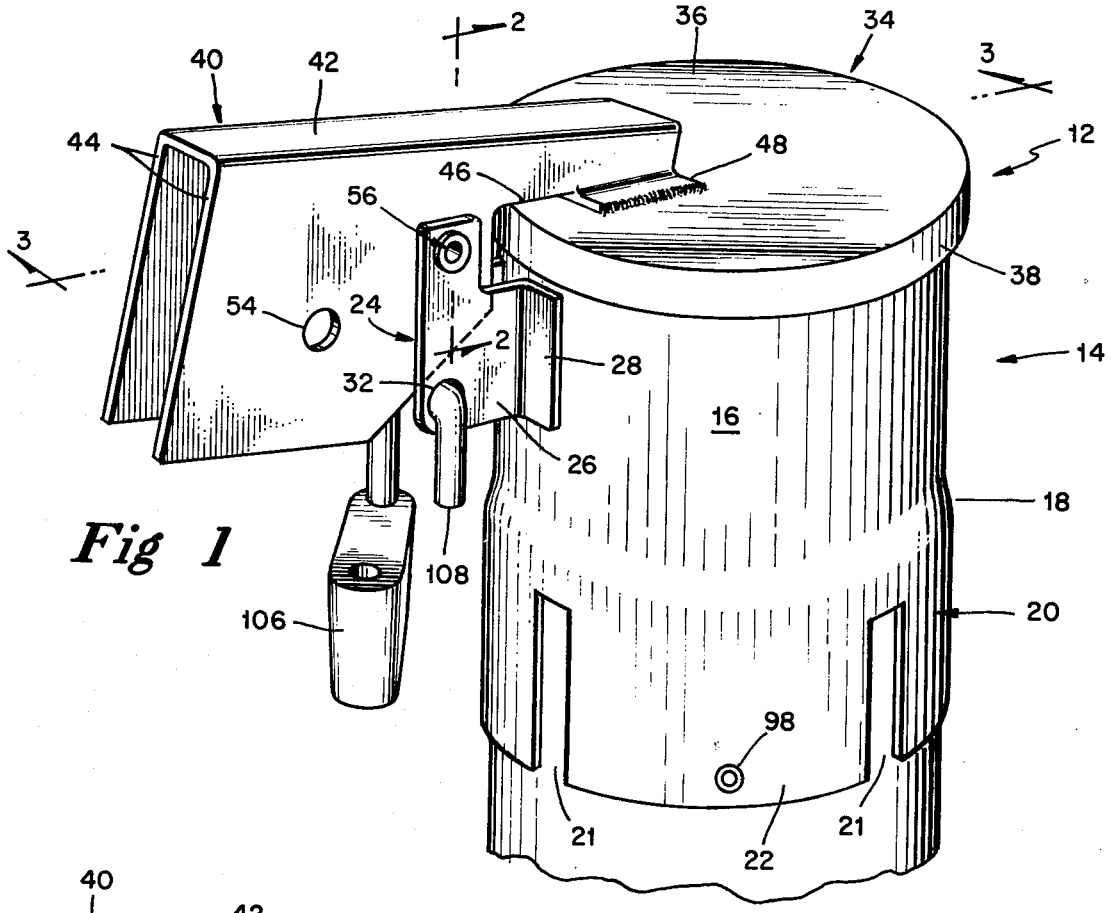
FIG. 1 is a perspective view of my cover device shown in a closed position atop the upper end of a vertical exhaust pipe.

With the foregoing in mind, the upper end of an exhaust pipe 10 has been illustrated in FIG. 1. My cover device is also shown generally in FIG. 1 and has been denoted in its entirety by the reference numeral 12. The particular modification of the invention, or at least parts thereof, which has been labeled 12 appears in FIGS. 1–5.

The device 12 includes a sleeve member 14 having an upper cylindrical portion 16, an intermediate shoulder 18 and a lower skirt portion 20 having a plurality of angularly spaced slots 21 which form resilient fingers 22. Although the sleeve member 14 can be selected for the particular size of exhaust pipe 10 with which it is to be used, it is possible to flex or swedge the fingers 22 so as to accommodate different diameters of pipes 10. In other words, a limited number of sleeve members 14 can be fabricated and made to fit various pipe sizes.

A pair of hinge brackets 24 are secured to one side of the cylindrical portion 16 of the sleeve member 14. Each bracket includes an L-shaped panel 26 and a mounting flange 28 extending generally perpendicularly with respect to the panel 26. The mounting flanges 28 of the two brackets 24 are spot welded at the proper elevation to the cylindrical portion 16. Further, each L-shaped panel 26 has a first hole 30 which accommodates a portion of a tubular pin yet to be described and a second hole 32 which accommodates the shackle of a padlock which also is yet to be described. In both instances, though, the holes 30 are in lateral alignment and the holes 32 are similarly aligned; the alignment is achieved at the time that the flanges 28 are spot welded to the cylindrical portion 16.

Figure 3:
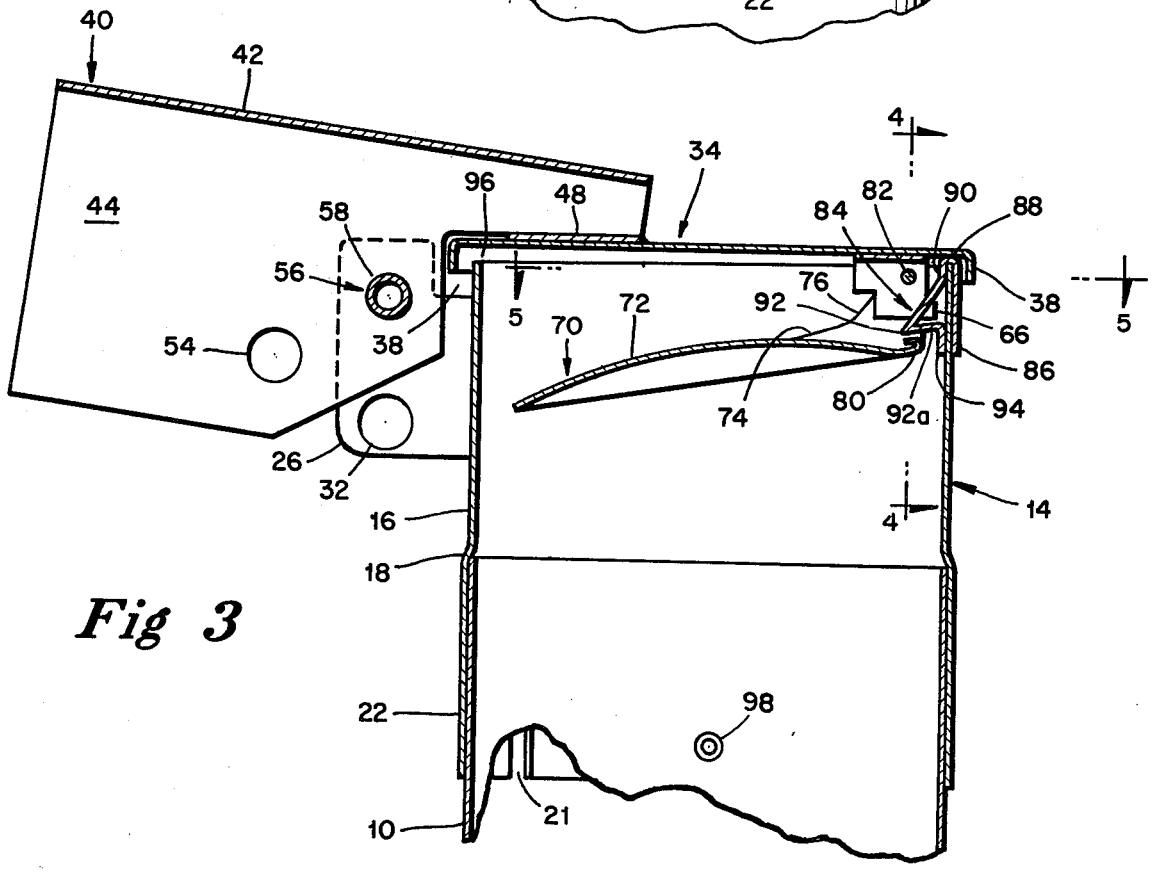
FIG. 3 is a sectional view taken in the direction of line 3—3 of FIG. 1 in order to show the pivotal vane that is suspended from the underside of the lid and the way the latching is effected in order to lock the lid in closed position when the engine is not running, the padlock again having been removed.
Figure 4:
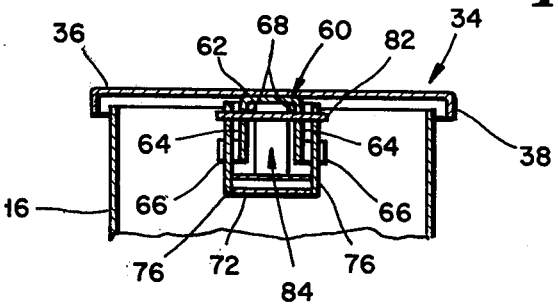
FIG. 4 is a sectional detail taken in the direction of line 4—4 of FIG. 3 in order to show the latching mechanism to better advantage.

A lid 34 is provided having a circular disc portion 36 of a diameter somewhat greater than the diameter of the cylindrical portion 16, thereby providing a peripheral overhang of the lid 34 with respect to the upper edge of the cylindrical portion 16 as can be best understood from FIG. 3. A cylindrical flange or skirt 38, which is integral with the disc portion 36, extends downwardly to an elevation beneath that of the upper edge of the cylindrical portion 16 thereby imparting a cup-shaped or upwardly recessed configuration to the lid, as can be seen in FIGS. 3 and 4.

As will be better understood as the description progresses, the lid 34 is counter weighted, and to achieve this a channel member 40 is employed having a web 42 with downwardly extending side walls 44. In order to enable the channel 40 to be conveniently attached to the lid 34, it is notched at 46 and provided with outturned flanges 48 which are spot welded to the lid 34. The side walls 44 have aligned holes 50, which together with the previously mentioned holes 30, receive the tubular pin presently to be referred to. From FIG. 2, it will be perceived that the holes 50 actually are provided with rolled edges 52. Additional holes 54 are formed in the side walls 44, these holes being registrable with the previously mentioned holes 32 in order that the shackle of a padlock may be inserted therethrough in order to hold the lid 34 open as will be more fully explained hereinafter.

Figure 2:
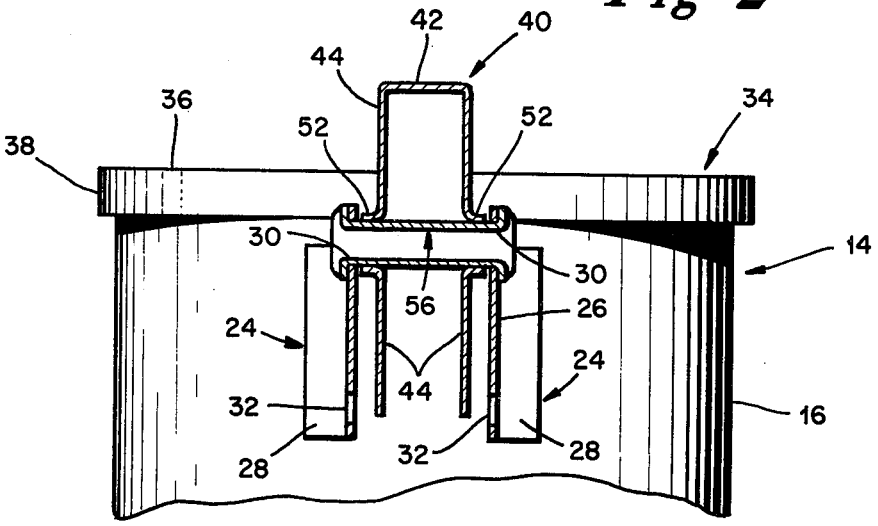
FIG. 2 is a sectional view taken in the direction of line 2—2 of FIG. 1 for the purpose of illustrating to better advantage the manner in which the lid is hinged, the padlock appearing in FIG. 1 not being illustrated.
Figure 5:
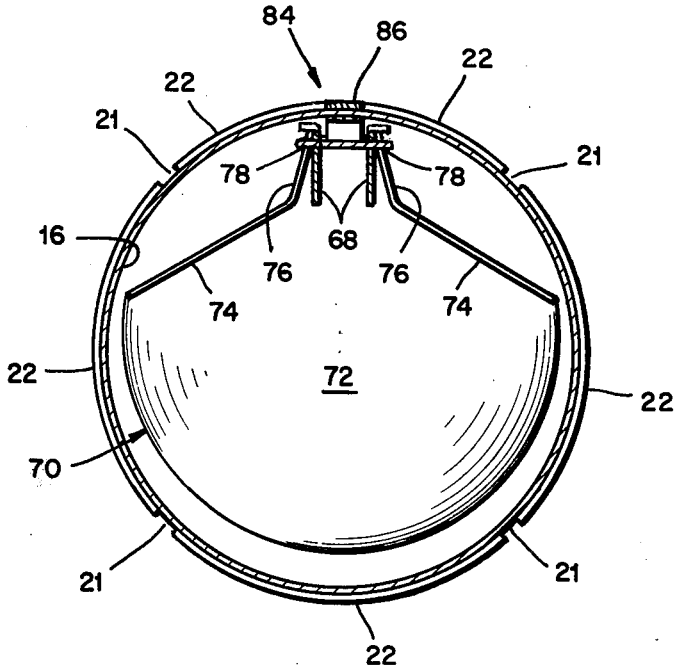
FIG. 5 is a sectional view taken in the direction of line 5—5 of FIG. 2, this view illustrating the pivotal suspension of the vane beneath the lid.

At this time, attention is directed to a tubular pin 56 as can best be viewed in FIG. 2. This pin 56 has rolled ends 58 that retain it in place once it has been inserted through the holes 30 and 50. Thus, once inserted and the ends rolled as just explained, the pin 56 functions as a hinge pin for the lid 34.

A U-shaped bracket 60 having a bight 62 and downwardly extending side panels 64 is secured to the underside of the lid 34. More specifically, the bight 62 is spot welded to the lid 34. The side panels 64 are formed with outturned tabs or stops 66 which perform a limiting function as will hereinafter be pointed out. The side panels 64 also are formed with aligned holes 68 for a purpose presently to be made manifest.

Playing an important role in the practicing of the invention is a vane 70, preferably fabricated from a thin stainless steel sheet. The vane 70 has a concavo-convex body portion 72 so that it possesses a domed appearance as can be seen from FIG. 3. It is desirable that the vane 70 be quite light in weight and the concave configuration just alluded to helps in this respect even though thin stock is utilized. The concavity also enhances the deflective action desired from the impingement of exhaust gases thereagainst. In order to lend even more rigidity to the vane 70, it is provided with upturned ribs 74 having slightly angled or diverging ears 76 at one end thereof, the ears 76 having aligned holes 78 therein. A catch 80 is provided which is reversely turned from the material residing between the ears 76, having a sloping upper surface for a purpose presently to be made manifest. A pin 82 pivotally connects the vane 70 to the underside of the lid 34, the pin 82 extending through the holes 68 in the side panels 64 of the previously mentioned U-shaped bracket 60 and the holes 78 that have just been alluded to as far as the ears 76 are concerned. Thus, the vane 70 extends in a cantilever manner beneath the lid 34 from its hinged side toward the hinged side of the lid 34. Owing to the angled relation or divergence of the ears 76 with respect to each other, and hence with respect to the panels 64, edges exist on the ears 76 which act as scrapers against the sides of the panels to dislodge any soot that may collect, thereby maintaining a free pivotal movement of the vane 70.

The catch 80 coacts with a keeper 84 to maintain the lid 34 closed when there are no upwardly flowing exhaust gases, that is when the engine is shut down. In this regard, the keeper 84 constitutes a reversely bent strip that is considerably narrower than the catch 80 so as to make the positioning of the keeper 84 considerably less critical. Describing the keeper 84, it will be observed that it has an outer shank portion 86 that confronts the outer surface of the cylindrical portion 16, a bight 88 that overlies the upper edge of said cylindrical portion 16, an inner strip or shank portion 90 that confronts the inner surface of the cylindrical portion 16, an offset or angled dog 92 providing a beveled striker plate 92*a* which angles slightly upwardly from the lowermost portion or tip of the dog 92, the angulation or slope corresponding to that of the upper surface of the catch 80. Because of the slope or angulation just mentioned, a better latching action is achieved and friction is reduced, especially from the cleaning of the engaging surfaces produced by the latching and unlatching. The keeper 84 terminates in a straight downwardly extending portion 94 which is directly beneath the upper portion 90. The portion 94 and also the lower portion of the outer shank 86 are spot welded to the cylindrical portion 16 of the sleeve member 14.

Close inspection of FIG. 3 will reveal that the underside of the lid 34, more specifically its circular disc portion 36, rests on the bight 88 so as to keep the lid 34 somewhat raised with respect to the upper edge of the cylindrical portion 16. Whereas the bight 88 provides a slight gap at the right side of the device as viewed in FIG. 3, the positioning of the hinge or brackets 24 at the left will provide a suitable gap 96. It has already been mentioned that the flanges 28 which are integral with the panel portions 26 of the brackets 24 are spot welded to the cylindrical portion 16. By spot welding the flanges 28 at the proper height, it will be understood that the tubular hinge pin 56 is raised somewhat and in this way the gap 96 is maintained. It is important to have the gap 96 plus a somewhat similar gap provided by reason of the bight 88 in order to assure an initial flow of exhaust gases; the reason for this will soon be dealt with.

It has already been pointed out that the skirt 20 composed of the plurality of fingers 22 extend downwardly and overlie the exterior of the upper end of the exhaust pipe 10. It follows that the fingers 22 must be securely attached to the exhaust pipe 10, for otherwise the entire sleeve member 14 could be removed from the exhuast pipe 10, thereby providing access to the interior of the exhaust pipe 10 when the internal combustion engine (not shown) is not running. To anchor the skirt 20, that is the various fingers 22, in place, pop rivets 98 are employed. These are conventional and are readily obtainable on the open market. Appropriate holes are first drilled at the time of installation and the rivets 98 simply inserted through the drilled holes, thereby securing the skirt 20 in a fixed relation with the upper end of the exhaust pipe 10.

Preferably, an additional means is employed which will even more positively assure the retention of the sleeve member 14 in place. In this regard, a strap or exhaust pipe clamp (not shown) can be used in an encircling relationship with the fingers 22 so as to force them tightly against the upper end of the exhaust pipe 10. Any such clamp would supplement the retention action of the pop rivets 98, and would make it even more difficult for vandals to remove the sleeve 14 from the exhaust pipe 10.

Having mentioned the holes 32 in the hinge bracket 24, it can now be pointed out that a padlock 106 can have its shackle 108 inserted through the holes 32 and this will prevent any counterclockwise or opening movement of the lid 34 about the hinge pin 56. Thus, the lid 34 can be externally locked in a closed position should circumstances so require. Also, the shackle 108 can be inserted through the holes 54 in the channel 40, which also functions as a counterweight, to maintain the lid 34 open, the holes 54 being registrable with the holes 32 in order to permit this. Of course, it is not necessary to make use of the shackle 108 to hold the lid 34 open, for any pin or nail that would be inserted through the holes 32 and 54 when aligned would serve the desired purpose.

Figure 7:
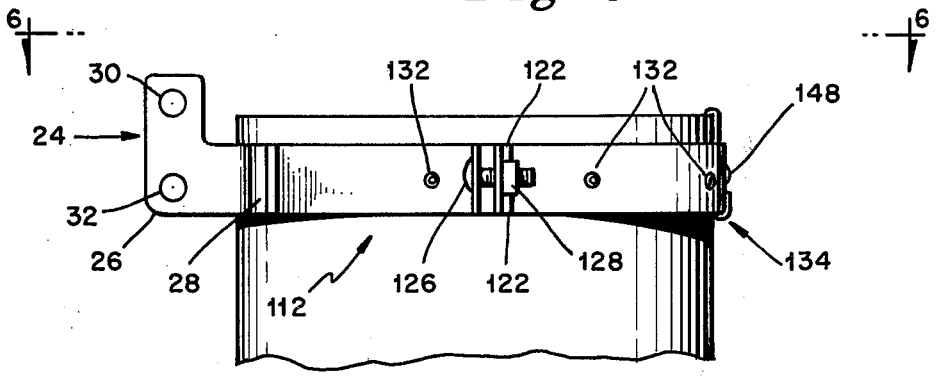
FIG. 7 is a side elevational view of the device illustrated in FIG. 6 but with the pivotal lid removed so as to show to better advantage the manner in which the hinged connection is effected.
Figure 6:
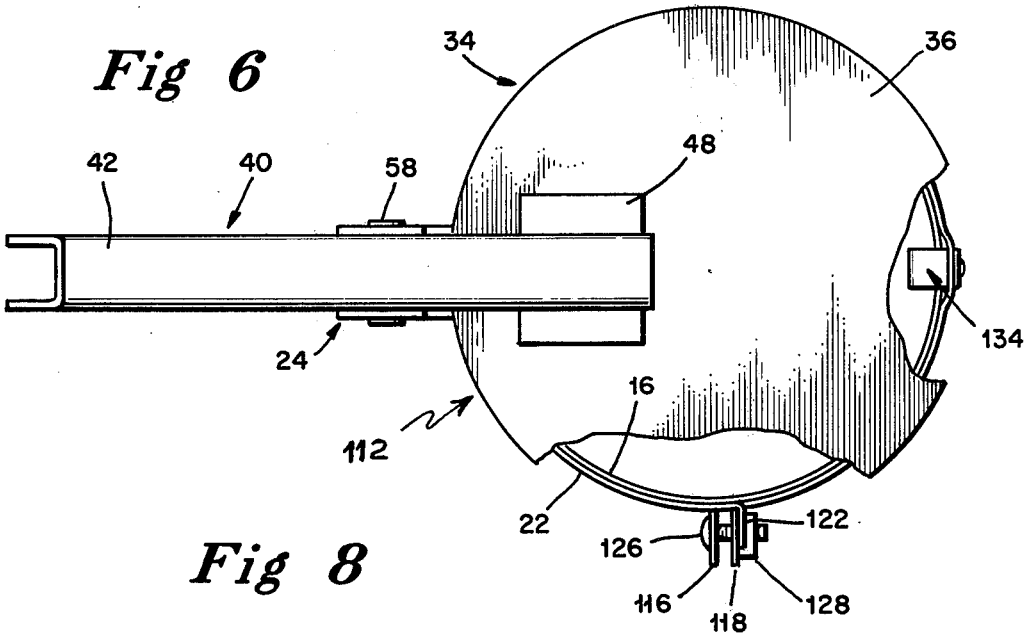
FIG. 6 is a top plan view taken in the direction of line 6—6 in FIG. 7 of a modified arrangement that my device can assume, this embodiment making use of a resilient strap which encircles the upper end of an exhaust pipe.
Figure 8:
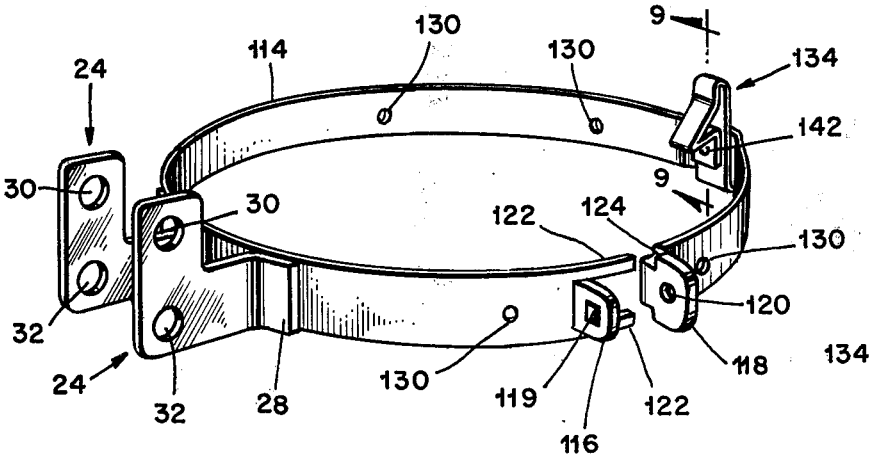
FIG. 8 is a perspective view of the strap utilized in the embodiment of FIGS. 6 and 7 before its attachment to the upper end of the exhaust pipe.

Describing now the embodiment pictured in FIGS. 6–8, it will be observed that the modified cover device has been given the reference numeral 112. As perhaps best understood from FIG. 8, the device 112 includes a flexible or resilient band 114 having outturned lugs or ears 116, 118, the lug 116 having a square hole 119 and the lug 118 having a round hole 120 therein. The lug 116 is formed so that a pair of tangs 122 remain when it is bent outwardly. The lug 118, on the other hand, is provided with upper and lower notches 124 which receive the tangs 122, the tangs 122 being bent as will be described immediately below.

At this time, attention is directed to a step or carriage bolt 126 (FIGS. 6 and 7), such bolts typically having rounded heads with the shank portion immediately adjacent the head being square. A square nut 128 is threadedly received on the step or carriage bolt 126. Thus, when the bolt 126 is inserted through the holes 120 and the nut 128 tightened thereon, the tangs 122 can then be bent so as to overlie in one instance and underlie in the other instance the flats of the nut 128. The tangs 122, owing to the relationship they have with the flats of the nut 128, prevent, or at least make it difficult, to back off the nut 128 after it has been tightened and the tangs 122 bent into place with respect to the opposite flats on the nut 128.

In addition to the step or carriage bolt 126 and the nut 128, reliance, as far as the retention of the band 114 is concerned, is also made on the various pop rivets. As can be perceived from FIG. 8, a plurality of holes 130 are formed in the band 114. From FIG. 7, it will be seen that pop rivets 132 are inserted in these holes and also holes drilled in the upper end of the exhaust pipe 10 at the time of installation.

Figure 9:
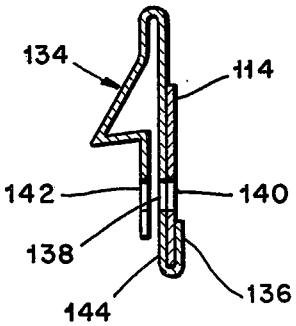
FIG. 9 is a sectional view taken in the direction of line 9—9 in FIG. 8.

Although the keeper labeled 134 is quite similar to the keeper 84, at least as far as its function is concerned, there is a slight difference in its configuration. Whereas the keeper 84 has a straight shank portion 86 that confronts the exterior of the cylindrical portion 16, the keeper 134 has a reversely turned end section 136 that extends under the lower edge of the band 114, more specifically a radially offset portion or bulge 135, the section 136 being spot welded to the offset portion 135 of the band 114. Additionally, there is a hole 138, corresponding generally to the holes 130, that goes through the band 114 and holes 140, 142 in straight portions of the keeper 134 labeled 144 and 146 (see FIG. 9). A pop rivet 148 extends through the band 114 and the inner portion that has just been alluded to, thereby firmly retaining the keeper 134 in place.

The hinge brackets 24 in the embodiment now being discussed have their flanges 28 welded directly to the band 114 in contradistinction to being welded to the cylindrical portion 16 as with the embodiment 12. From FIG. 7, it will be observed that the same holes 30 and 32 are formed in the panel portions 26 of the brackets 24. Thus, a tubular hinge pin 56 is utilized to pivotally connect the lid 34 to the brackets 24. The lid 34, as with the embodiment 12, has pivotally suspended therefrom a vane 70.

Thus, it is believed readily apparent that a flexible or resilient band 114 is employed in the embodiment labeled 112 in lieu of the sleeve member 14. This modification, for one thing, will accommodate greater differences in exhaust pipe diameters.

OPERATION

Assuming that the internal combustion engine (not shown) having the fragmentarily depicted exhaust pipe 10 has been shut down, then there would be no upward flow of exhaust gases. Consequently, the lid 34 gravitationally drops in place at the top edge of the sleeve member 14. Although the channel 40 functions as a counterweight, its mass is somewhat less than that of the lid 34 and vane 70. In other words, the lid 34 is gravitationally biased into a closed position and it is due to the channel 40 that very little force is required from the exhaust gases acting on the underside of the lid 34 to cause the lid 34 to pivot open in a counterclockwise direction as viewed in FIG. 3, doing so about the tubular hinge pin 56.

Consequently, as soon as the engine is started up, the exhuast pipe impinge against the vane 70 and by reason of its cantilever mounting, being pivotally suspended only at one side by the pin 82, the gases cause it to be rocked or pivoted in a clockwise direction as viewed in FIG. 3, the concavity of the vane assisting in concentrating the gases so that the vane immediately pivots or deflects upwardly. Owing to the positioning of the pin 82 and the resulting moment arm, such movement shifts the catch 80, which is integral with the vane 70, from beneath the keeper 84, more specifically the dog 92 and the beveled striker portion 92*a*.

The gap 96 subjacent the lid 34 is needed to first lift the vane 70 so as to effect the unlatching that is needed to allow the lid 34 to open. It will be appreciated that the gap 96 permits a sufficient initial flow or venting of exhaust gases to effect a pivotal movement or rocking of the vane 70; without the gap 96, there would not be the requisite actuating gas flow. In some cases, depending mainly on the relative masses of the lid 34 and the vane 70, the lid 34 may pivot upwardly before any substantial rocking of the vane 70 occurs. This will merely cause the catch 80 to move upwardly and bear against the keeper 84, eliminating any clearance that may have existed. Immediately thereafter, though, the vane 70 will swing upwardly, that is pivot clockwise as viewed in FIG. 3, so that the catch 80 rubs or wipes against the striker plate 92*a* during the unlatching process, removing any soot that may have collected on the striker plate 92*a* in so doing, and in such cases facilitating a relatching when the exhuast gas flow ceases.

The catch 80 and keeper 84 constitute a latch means or mechanism for the lid 34, so with the catch 80 shifted from beneath the dog 92, the lid 34 is free to pivot upwardly in a counterclockwise direction about the hinge pin 56. It is the upward force derived from the exhaust gases that keeps the lid 34 raised or open as long as the engine is running.

As soon as the engine is shut down, then there are no longer any forces provided by the exhaust gases and the over balancing of the lid 34, together with the vane 70 suspended therefrom, causes the lid 34 to close. As the lid 34 pivots under the influence of gravity in a clockwise or closing direction, due to the diminishing exhaust gases, the catch 80 moves downwardly to the elevation of the beveled striker plate 92*a*, at which time the catch 80 slides beneath the striker plate 92*a*. Once this has happened, then it is necessary that the engine be restarted in order to provide the requisite flow of exhaust gases to pivot or raise the vane 70 to the extent that the catch 80 clears the dog 92 to unlatch the lid 34 so that it can move upwardly under the influence of the flowing exhaust gases. The angulation of the striker plate 92*a* assures that it will be wiped clean each time a latching and unlatching action occurs.

From the foregoing, it should be readily apparent that when the engine is shut down and left unattended, the lid 34 cannot be manually opened because of the locking or latching action that takes place. Hence, vandals cannot pour water, dirt, sand or other foreign matter into the exhaust pipe 10 where it can damage the engine therebeneath. Also, any wind that acts against the lid 34 cannot open the lid, for the same locking action prevents such a happening. Thus, it should be obvious that my device 12 is not only tamper proof but also wind proof as well.

It should be pointed out that the location of the hinge pin 56 is at an elevation lower than the lid 34 so as to be out of the direct path traversed by the exhaust gases as they exit from the sleeve member 14. Consequently, there is little likelihood of heat from the gases causing distortion to the extent that any binding would result. Thus, the lid 34, once released, is always free to pivot quite readily into an open position and also back to a closed position when there are no exhaust gases.

If it is known that a visual inspection should be made of the parts constituting my device 12, then with the engine running, the holes 54 in the channel 40 can be moved into alignment with the holes 32. When registered, the shackle 108 can be inserted, or any other appropriate obstruction threaded through the aligned holes, to maintain the lid 34 raised or open. While this technique can be resorted to if visual inspection is planned, or if the internal parts of the device 12 require cleaning, there can be other reasons for wishing to keep the lid 34 open and the alignment of the holes just described permits this to be accomplished.

On the other hand, the use of the shackle holes 32, with the channel 40 in the position illustrated in FIG. 1, will prevent the lid 34 from being opened, either manually or automatically. Thus, should the device 12 ever become ineffectual, such as from damage to any of its parts, the lid 34 can be locked closed by resort to the padlock 106. When being transported, the equipment sometimes is moved beneath the limbs of trees which would brush against the lid 34 to such as extent that an undue strain would be imposed upon the latch mechanism composed of the catch 80 and the keeper 84 which conceivably could cause breakage of the parts. The positive locking action provided by the shackle 108 prevents any such occurrence.

The operation of the device 112 is the same as that of the device 12. The only difference resides in the utilization of the band 114 and its mode of attachment in contradistinction of the band 114 and its mode of attachment in contradistinction to the use of the sleeve 14 and its mode of attachment as far as the exhaust pipe 10 is concerned.

I claim:

1. A tamper-proof weather cover device for a vertical exhaust pipe comprising a lid member, means mounting said lid member for pivotal movement about a first horizontal axis so that said lid member gravitationally closes the upper end of said exhaust pipe when there is an insufficient flow of exhaust gases to open said lid member, a vane member, means attaching said vane member to the underside of said lid member for pivotal movement about a second horizontal axis so that said vane member gravitationally pivots downwardly about said second horizontal axis to a first position when there is an insufficient flow of exhaust gases, a first latch member having a fixed portion thereof spaced substantially vertically beneath said second axis, and a second latch member carried on said vane member and movable therewith, said second latch member swinging into a position spaced substantially vertically beneath said second axis and beneath the fixed portion of said first latch member to keep said lid member closed when said vane member is in its said first position, whereby when a sufficient flow of exhaust gases occurs, said vane member is pivoted to a second position to move said second latch member from beneath the fixed portion of said first latch member to permit said lid member to open.

2. The device of claim 1 in which said lid member is upwardly recessed or cup-shaped.

3. The device of claim 2 in which said lid member is upwardly recessed or cup-shaped by reason of a downturned flange.

4. The device of claim 2 in which said vane member is concave.

5. The device of claim 4 in which said vane member is rendered concave by reason of a domed configuration.

6. A tamper-proof weather cover device comprising a lid member of a size larger than the upper end of a substantially vertical exhuast pipe so that said lid member can overlie and close the upper end of said pipe, means for pivotally attaching one edge portion of said lid member adjacent said upper pipe end at a location outside said pipe end so that the peripheral edge of said lid member extends laterally beyond said pipe end, a vane member of a smaller size than said pipe end so as to fit within said pipe end, means pivotally attaching one edge portion of said vane member to the underside of said lid member at a location spaced inwardly from said peripheral edge so that said vane member resides within said pipe end and extends in a cantilever manner beneath said lid member, and latch means within said pipe end operable by said vane member to latch said lid member closed when there is no exhaust gas flow and said vane member is permitted to pivot downwardly due to gravity, and to unlatch said lid member when there is a sufficient exhaust gas flow to pivot said vane member upwardly to permit said lid member to open.

7. The device of claim 6 in which said lid member includes a flange extending downwardly from its said peripheral edge.

8. The device of claim 6 in which said vane member has a downwardly facing concave side.

9. The device of claim 6 in which the pivotal attaching means for said one edge portion of said vane member includes a first hinge unit secured to said lid member at said inwardly spaced location and a second hinge unit secured to said vane member, and a hinge pin extending through said hinge units to provide the pivotal connection for said vane member relative to said lid member within said pipe end.

10. The device of claim 9 in which said first hinge unit constitutes a U-shaped bracket having a bight portion secured to said lid member at said inwardly spaced location and downwardly extending parallel plate portions, said second hinge unit including a pair of diverging plate portions extending upwardly from said vane member within said pipe end, said pin extending through said plate portions.

11. The device of claim 10 in which said plate portions of said first hinge unit have oppositely issuing tabs engageable by the edges of the plate portions of said second hinge unit to limit downward pivotal movement of said vane member.

12. A tamper-proof weather cover device for a vertical exhaust pipe comprising a lid member, means for pivotally attaching one edge portion of said lid member adjacent one side of the upper end of a substantially vertical exhaust pipe, a vane member, means pivotally attaching one edge portion of said vane member to the underside of said lid member adjacent a second edge portion thereof generally opposite said one edge portion of said lid member so that said vane member extends in a cantilever manner beneath said lid member, and latch means operable by said vane member to latch said lid member closed when there is no exhaust gas flow and said vane member is permitted to pivot downwardly due to gravity, and to unlatch said lid member when there is a sufficient exhaust gas flow to pivot said vane member upwardly to permit said lid member to open, said latch means including a catch on said vane member spaced at a distance below said second edge portion of said lid member and a keeper engageable by said catch, said keeper being fixedly mounted with respect to said lid and vane members.

13. The device of claim 12 in which said means for pivotally attaching said vane member to said lid member includes a transverse pin, said catch, keeper and pin being in substantial vertical alignment when said lid member is latched closed.

14. The device of claim 12 in which said keeper has a beveled or angled striker portion engageable by said catch.

15. The device of claim 14 in which said catch is wider than said keeper.

16. The device of claim 12 including means for encircling the outside of the upper end of the vertical exhaust pipe, said means for pivotally attaching said one edge portion of said lid member being mounted on said encircling means.

17. The device of claim 16 in which said means for pivotally attaching said one edge portion of said lid member includes a bracket extending from said encircling means and a counterweight member secured to said lid member, and a hinge pin extending through said bracket member and said counterweight member.

18. The device of claim 17 in which said bracket has a hole for accommodating the shackle of a padlock so that the shackle of the padlock provides obstructive interference with said counterweight member.

19. The device of claim 18 in which said counterweight member has a hole movable into registry with the hole of said bracket member so that said lid can be locked by the padlock in an open or raised position.

20. The device of claim 17 in which said encircling means includes a sleeve having downwardly extending, angularly spaced fingers.

21. The device of claim 20 including a plurality of rivets extending through said fingers and the upper end of said vertical exhaust pipe.

22. The device of claim 17 in which said encircling means includes a resilient band having outturned ends, each outturned end having a hole therein, a bolt extending through the holes of said outturned ends and a nut on said bolt.

23. The device of claim 22 in which one of said holes is square and the other round, said bolt having a square shank portion extending into said square hole.

24. The device of claim 22 in which one of said outturned ends has tangs that can be bent into an obstructive interference with said nut to prevent facile removal thereof from said bolt.

25. The device of claim 24 including a plurality of rivets extending through said resilient band and the upper ends of said vertical exhaust pipe.

* * * * *